US005980181A

United States Patent [19]

Franks

[11] Patent Number: 5,980,181

[45] Date of Patent: Nov. 9, 1999

[54] APPARATUS FOR APPLYING A WRAPAROUND COVER TO A PAD OF PAPER

[75] Inventor: James M. Franks, Burlingame, Kans.

[73] Assignee: Brackett, Inc., Topeka, Kans.

[21] Appl. No.: 08/921,506

[22] Filed: Sep. 2, 1997

[51] Int. Cl.[6] ..... B42C 11/02

[52] U.S. Cl. ..... 412/19; 281/29; 412/9; 412/37; 412/901; 412/902

[58] Field of Search ..... 412/9, 19–22, 412/33, 37, 901, 902; 281/29

[56] References Cited

U.S. PATENT DOCUMENTS

| | | | |
|---|---|---|---|
| 4,094,500 | 6/1978 | Kunzmann . | |
| 4,139,216 | 2/1979 | Saint Clair | 281/19.1 |
| 4,151,037 | 4/1979 | Klingelhoefer et al. . | |
| 4,237,568 | 12/1980 | Kunsmann . | |
| 4,266,761 | 5/1981 | Buck . | |
| 4,710,256 | 12/1987 | Ladewig et al. | 156/484 |
| 4,779,897 | 10/1988 | Schall et al. . | |
| 4,850,614 | 7/1989 | Shanahan et al. | 462/8 |
| 4,906,156 | 3/1990 | Axelrod | 412/21 |
| 4,932,301 | 6/1990 | Buck . | |
| 4,975,011 | 12/1990 | Holmberg | 412/6 |
| 5,143,404 | 9/1992 | Flowers, Jr. | 281/21.1 |

*Primary Examiner*—Andrea L. Pitts
*Assistant Examiner*—Monica Smith
*Attorney, Agent, or Firm*—Litman, Kraai & Brown, L.L.C.; John C. McMahon

[57] ABSTRACT

An apparatus for applying a wraparound cover to a pad includes a loading station, a creasing station having a pair of knife edges and an anvil for applying a pair of parallel creases in the cover, a gluing station for applying a bead of glue to an under side of the pad and a folding station for folding an overlap portion of the cover about the rear and underside of the pad so as to engage the glue bead. The folding station includes a holddown mechanism and an articulated hand that folds the cover overlap portion at each crease about the rear edges of the pad.

13 Claims, 4 Drawing Sheets

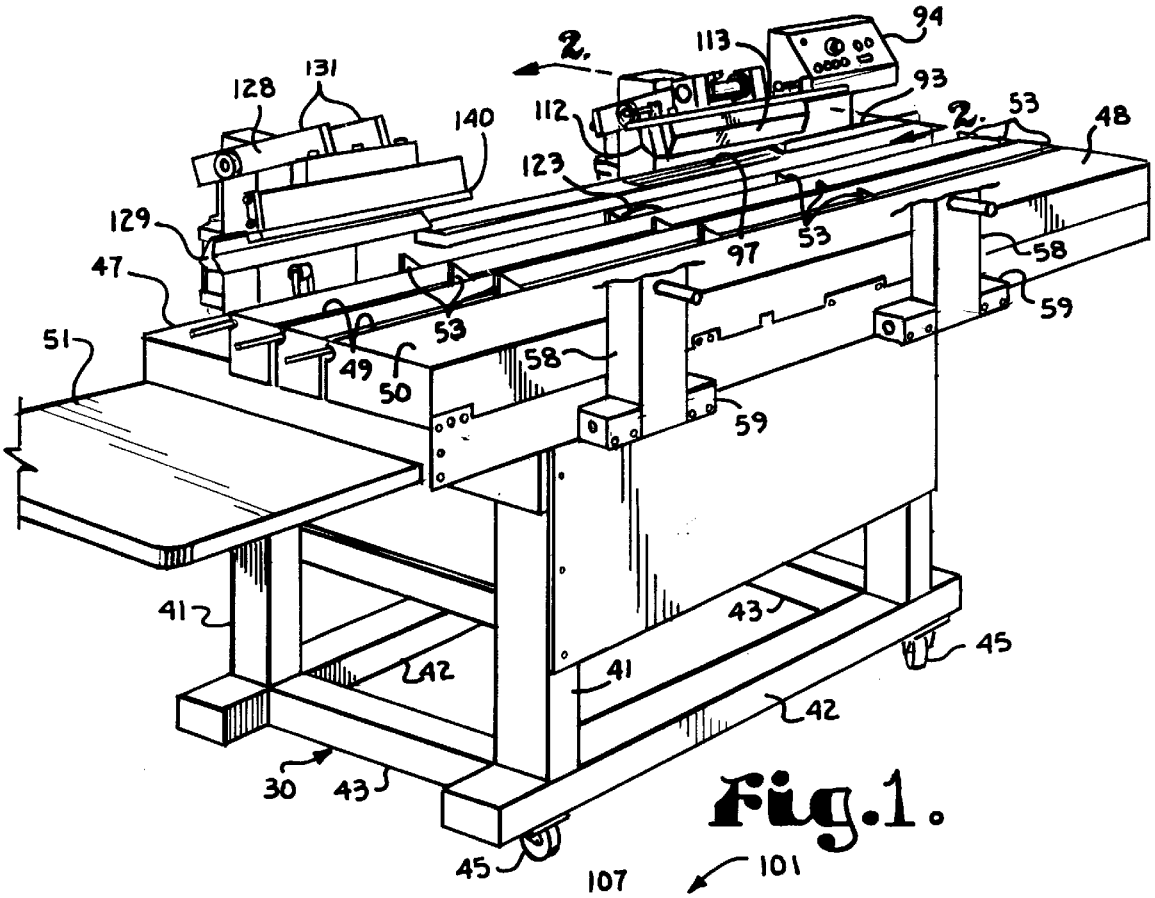
Fig.1.
Fig.2.
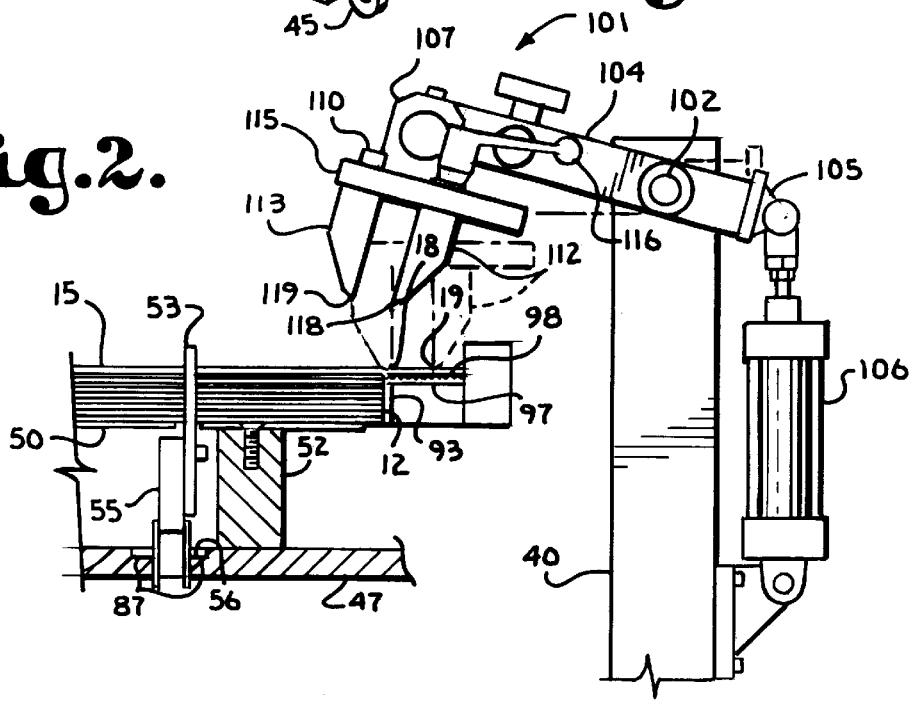

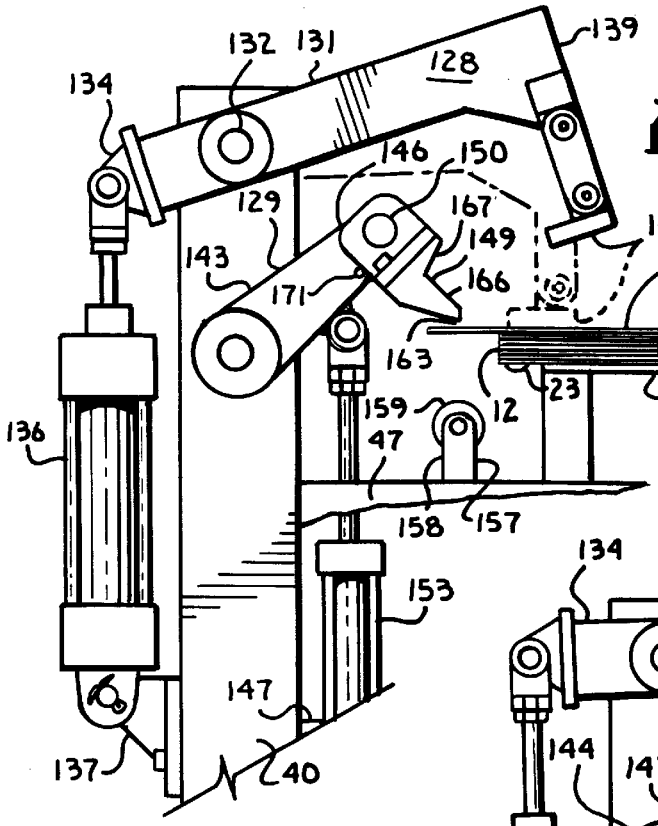
Fig. 5.
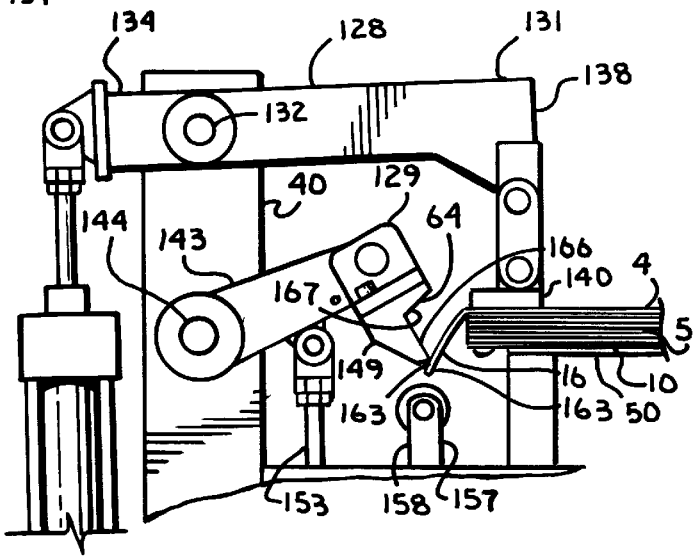
Fig. 6.
Fig. 7.
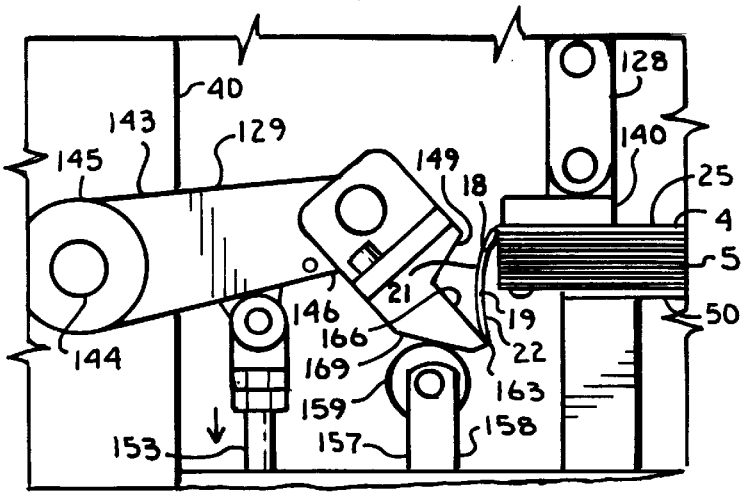

APPARATUS FOR APPLYING A WRAPAROUND COVER TO A PAD OF PAPER

BACKGROUND OF THE INVENTION

The present application is directed to an apparatus for applying a wrap around cover to a pad created sheets of paper and preferably to such a pad having a pre-existing backing and wherein the sheets of paper are adhered together near one end thereof. The application is also directed to the method of forming a cover pad with such an apparatus.

Tablets and pads that are formed by joining together multiple sheets of paper are quite common and extremely varied in type. Some such articles have paper that have been previously printed, such as forms, certain blank sheets, such as note pads, or the like. The paper in such goods is usually joined in stacks by gluing, stapling or some other means, typically at or near one end of a stack of the paper. Because of the wide variety of shapes and sizes of such tablets and pads, it is sometimes quite difficult to design machines that are sufficiently varied to be able to make or further process pads of many different sizes and shapes. Consequently, pads of this type often require intensive manual labor which is quite expensive and slow for both initial manufacture and customization.

The present invention is directed to a semi-automated apparatus which applies a wrap around cover to a pad of paper of the type described above. In particular, pads, such as note pads, are often provided with multiple sheets of paper with a stiff back constructed of cardboard or the like. It is often desirable in these types of pads, especially for certain markets, to provide a wraparound cover which is adhered to the back, but which wraps around and covers the front of the pad in a manner so as to allow a user to lift the cover and use the pad. Joining of such a wraparound cover with a pad has typically been performed by the manual labor described above. The purpose of the apparatus and method of the present invention is to provide for such covers to be applied in a rapid and at least semi-automated manner so as to improve quality, reduce cost and substantially increase speed, especially when the pads are manufactured and fed to the apparatus from an automated production line.

SUMMARY OF THE INVENTION

An apparatus is provided for joining a wraparound cover to a previously constructed pad of multi sheets of paper laid in a stack. Preferably the pad is previously provided with a stiff back and the various sheets of paper are adhered or bound together in some manner near the rear end of the pad so that each sheet may be written on and either left in the pad or removed from the pad.

The apparatus preferably adheres the wraparound cover to the underside of the pad backing and folds the wraparound cover in such a manner that it folds about the rear end of the pad, such that a portion of the cover extends over the front surface of the pad. In this manner the cover may be easily raised and folded back over the rear and back of the pad should a user wish to write on the front page of the sheet contained in the pad.

The apparatus includes four stations. The first station is a loading station where an operator manually places the pad on a receiving surface of the apparatus and also lays a cover in an unfolded configuration on top of the pad. The apparatus includes a series of mechanically operated pushers which automatically engage each pad and sequentially convey it to subsequent stations.

The second station includes a crimping or creasing device. The creasing device has an anvil over which the rear end of the cover extends as it moves into the second station. The creasing apparatus also includes a pair of spaced knife edges which are sized to extend across a cover and are spaced in such a manner as to position grooves or creases in the cover at the location of desired bending of the cover about the end of the pad. The knife blades are operably driven against one side of the cover while the anvil is positioned on the other side of the cover in such a manner that the knife blades crease the cover to allow for preferred folding of the cover at that location.

The pad and cover, as a unit, then proceed to the third station where a roller apparatus applies glue in a pre-selected width to the underside of the pad back. The glue strip is applied such that it will be engaged by the wraparound cover when the cover is folded at the creases and wrapped around the back side of the pad.

The pad and cover are then conveyed to the fourth station where a mechanical hand engages the portion of the cover which extends beyond the end of the pad and wraps that portion of the cover about the end of the pad and partially over a part of the rear of the pad backing, such that a portion of the wraparound cover engages the glue strip. The hand is designed to encourage the wraparound cover to fold at the creases and become smoothly and snugly wrapped about the rear end of the pad.

Subsequently, the pad with the wraparound cover secured to the pad is discharged from the apparatus and stacked with other such pads.

OBJECTS AND ADVANTAGES OF THE INVENTION

Therefore, the objects of the present invention are: to provide an apparatus for automating the addition of a wraparound cover to a pad of paper; to provide such an apparatus which includes processing stations for creasing the cover to fold at the corners of the pad and to wrap around the end of the pad to provide for the application of glue between the cover and the pad for adhering the cover to the pad; to provide a folding mechanism having a hand and a holddown mechanism for folding the cover about the pad at the final station; and to provide such an apparatus which is easy to use, inexpensive to produce and especially adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of an apparatus for applying a wraparound cover to a pad of paper.

FIG. 2. is an enlarged and fragmentary cross sectional view of the apparatus illustrating a creasing device in solid lines prior to creasing and in phantom lines during the creasing procedure.

FIG. 5 is an enlarged and fragmentary cross sectional view of the apparatus, taken along line 5—5 of FIG. 4, illustrating a fourth station of the apparatus wherein the end of the wraparound cover is folded about the end of the pad and illustrating the apparatus prior to initiation of the folding operation in solid lines and subsequent to initiating of the folding operation in phantom lines.

FIG. 6 is an enlarged and fragmentary cross sectional view of the apparatus from a similar view of FIG. 5 showing a second stage in the folding operation wherein a hand engages the end of the wraparound cover.

FIG. 7 is an enlarged and fragmentary cross sectional view of the apparatus similar to FIG. 5 showing a third stage in the folding operation wherein a hand engages a roller so as to change the movement direction of the hand.

DETAILED DESCRIPTION OF THE INVENTION

Figure 3:
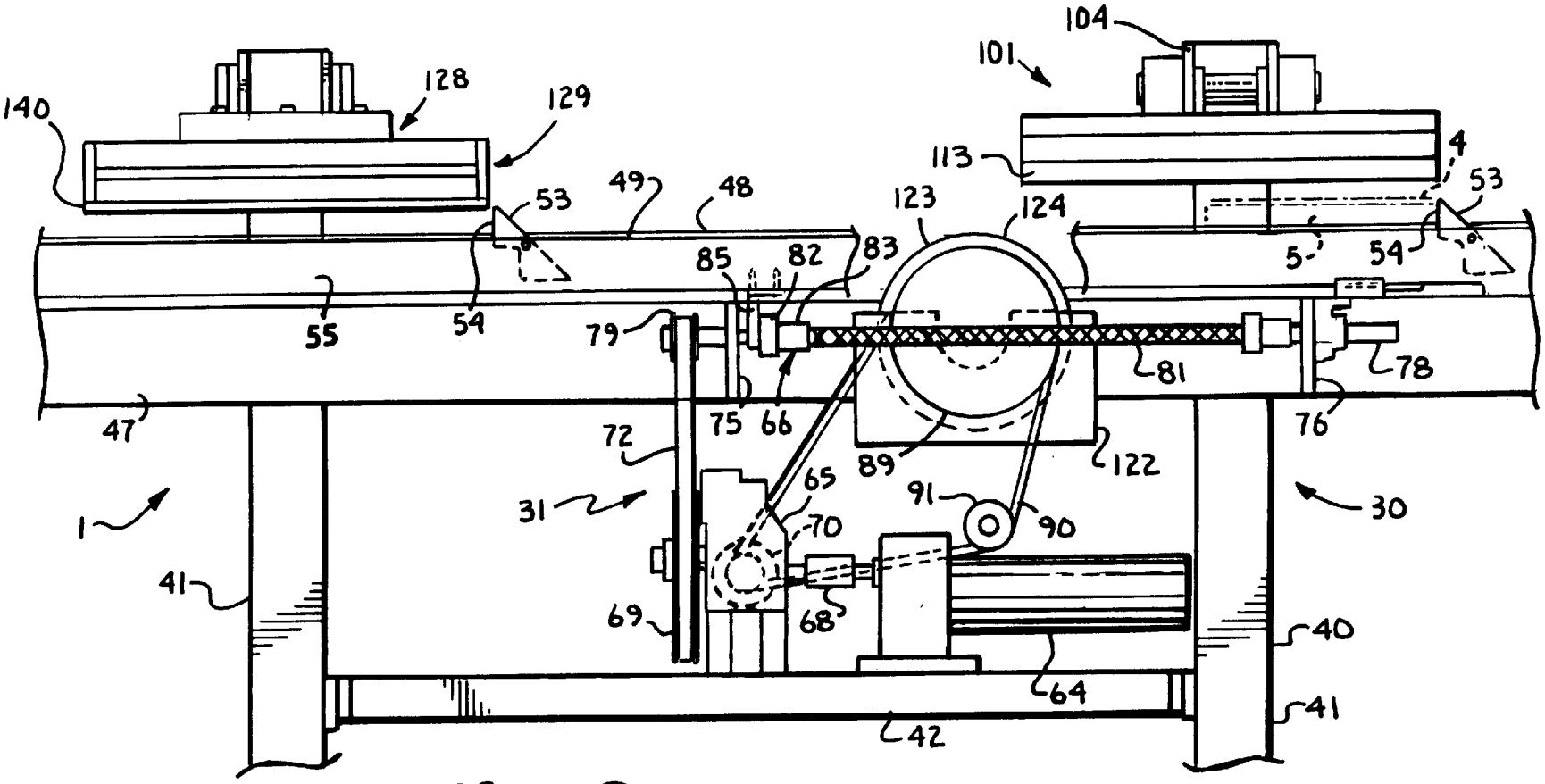
FIG. 3 is an enlarged side elevational view of the apparatus, showing various interior portions of the apparatus in phantom lines and with certain portions removed to show better detail thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates an apparatus for applying a wraparound cover 4 to a pad of paper 5.

The pad of paper 5 includes a stack of individual sheets 9 that are suitable to use for note taking or the like. The pad 5 also includes a backing sheet 10 constructed of a stiff material such as cardboard or the like. The paper sheets 9 and the backing sheet 10 are approximately the same size and shape and are stacked and secured or bound together along a rear edge 12 by glue, stapling or other means of binding. In this manner each individual sheet 9 of paper in the pad 5 may be sequentially used for such purposes as note taking or the like and either removed or left in the pad as desired by the user.

Secured to the pad 5 by the method of the present invention is the wraparound cover 4 which is applied by the apparatus 1. The wraparound cover 4 initially is a flat oversized sheet 15 that is the same width, but somewhat longer than the sheets 9, as seen in FIG. 5. The sheet 15 extends beyond the pad 5 toward the rear of the pad 5 so as to provide an overlap portion 16. A first folding groove or crease 18 and a second folding groove or crease 19 are placed in the overlap portion 16 during attachment of the cover 4 to the pad 5. The crease 18 extends across the width of the pad 5 and is parallel to the rear of the pad 5. The crease 18, when the cover 4 is properly positioned is located directly above the rear edge of the pad 5.

The crease 19 is parallel to the crease 18 and is spaced therefrom the height of the pad 5. Once installed the overlapped portion 16 wraps around the back and somewhat under the pad 5. The overlapped portion 16 thus forms a cover rear section 21 and a cover bottom section 22. A bead of glue 23 is placed along the underside of the pad backing sheet 10 parallel to the rear of the pad 5 and in close proximity thereto. The cover bottom section 22 is placed over and secured by the bead of glue 23 during attachment of the cover 4 to the pad 5, as will be described further below. In this manner the wraparound cover 4 is secured to the pad 5 by the bead of glue 23 along the cover bottom section 22 only, thereby leaving the remainder 25 of the cover 4 free to fold rearwardly about the crease 19 in which case the cover rear section 21 folds with the remainder 25 of the cover 4 or alternatively to fold at the crease 18 in which just the top of the cover 4 pivots upwardly and rearwardly. The cover 4 can thereby be raised from the paper sheets 9 and can also be folded further back under the pad 5 so that the top 25 of the cover 4 engages the pad backing sheet 10, such that the cover 4 is completely out of the way of the user.

The apparatus 1 includes a frame and support structure 30, a drive mechanism 31, a first loading station 32, a second creasing station 33, a third glue application station 34 and a fourth folding station 35. The frame and support structure 30 has a frame 40 having four upstanding legs 41 connected by cross beams 42 and 43. The frame 40 sits on castor wheels 45 which allow movement of the apparatus 1 about the work area.

Located at the top of and mounted on the frame 40 is a support table 47. Associated with the support table 47 is an upper surface 48 having a series of parallel longitudinal tracks 49 that are aligned with movement of pads 5 through the various stations 32 to 35. The upper surface 48 receives the back side or backing sheet 10 of the pad of paper 5, as is shown at various stations in FIGS. 3 and 5. The pad 5 is initially placed on the surface 48 in the region of the first loading station 32, and the wraparound cover 4 in the form of a blank sheet of stock 15 is placed over the pad 5 such that the overlapped portion 16 extends rearward to the left, as seen in FIG. 5. The surface 48 is located on a plate 50 that is supported by the remainder of the support table 47.

The support table 47 includes a discharge surface 51 which receives the pads 5 at the completion of the process for applying the cover 4 thereto. The discharge surface 51 is positioned vertically beneath the upper surface 48 so that the pads 5 may be collected thereon. The plate 50 is spaced from the remainder of the table 47 by a series of spaced and elongate beams 52.

The tracks 49 slidingly receive a series of spaced pusher elements 53. Each of the pusher elements 53 has a triangular pad engaging portion 54 and is mounted on an elongate slide 55 so as to be swingably mounted about the middle thereof and moveable along each respective track 49. Each slide 55 is mounted in a track 56 on the support table 47. The pusher elements 53 are driven by the drive mechanism 31 in a manner as described below. The pusher elements 53 function as a conveyor mechanism and are moved in a reciprocating manner so that they propel each pad 5 through respective stations 32, 33, 34 and 35 and thereafter discharge each pad 5 onto the discharge surface 51. After the pads 5 are propelled to each subsequent station, the direction of the pusher elements 53 is reversed and they fold downwardly so as to travel beneath the plate surface 48 and rearward pads so as to return to their initial starting point for pushing the pads 5 to the next station.

Figure 4:
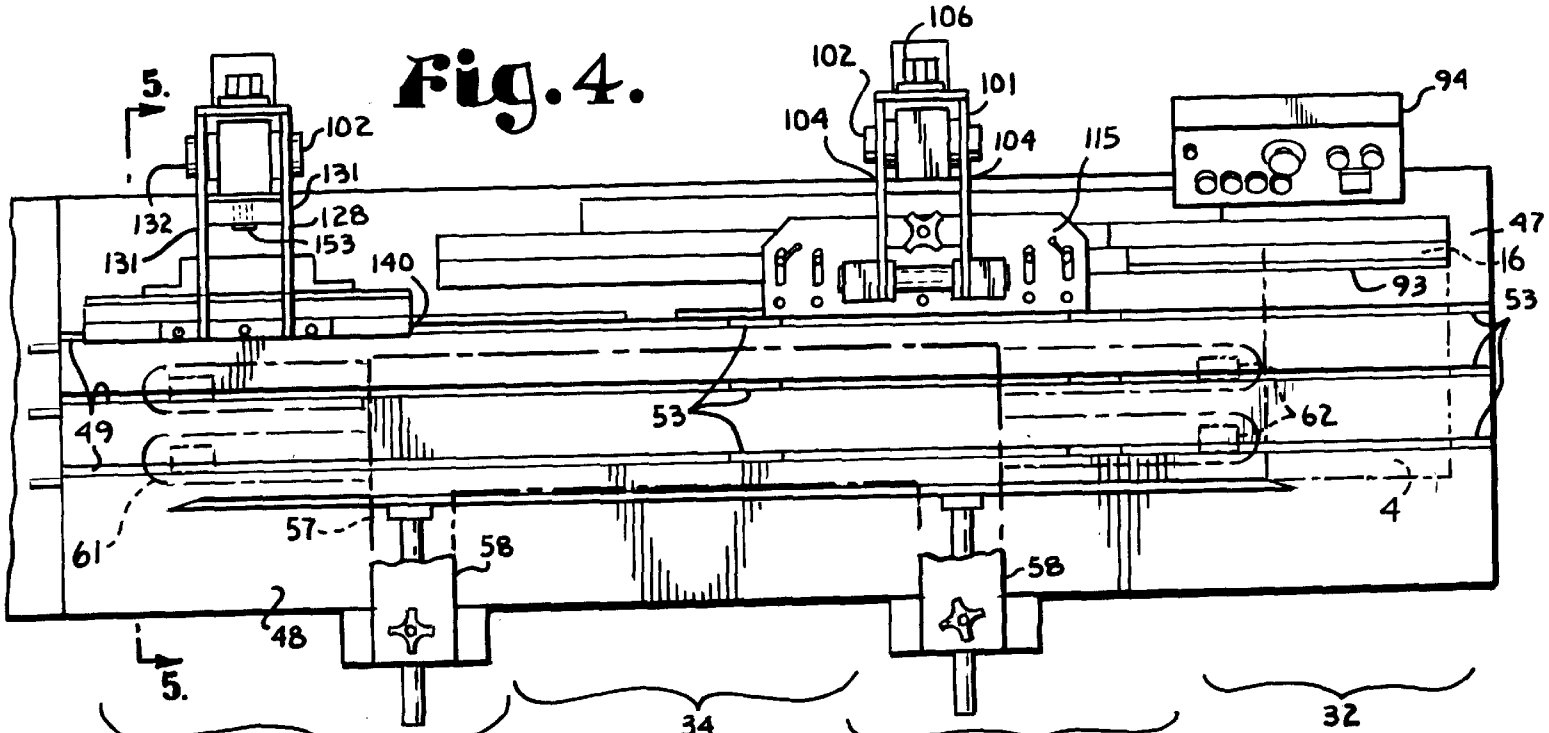
FIG. 4 is a top plan view of the apparatus.

A holddown assembly 57 is also mounted on the support table 47. The holddown assembly 57 is supported by two swingable arms 58 to rotate about hinges 59. The holddown assembly 57 includes an elongate cover 61 which is shown mainly in phantom in FIG. 4 so as to allow better illustration of the remainder of the apparatus 1. The cover 61 has a series of rollers 62 depending therefrom that engage the upper surface of the wraparound cover 4 during transfer through stations along the plate 50 so as to ensure that the pusher elements 53 properly position and convey the pad 5 and cover 4 through the stations 32 to 35 and to hold the pad 5 and cover 4 down during the transfer therealong.

The drive mechanism 31 is best illustrated in FIG. 3. The drive mechanism 31 includes an electric drive motor 64, a transmission or gear reduction box 65 and a reciprocating mechanism 66. The motor 64 is connected to the transmission 65 by a coupling 68. The transmission 65 has two power takeoff pulleys 69 and 70. The pulley 69 is operably connected by a drive belt 72 to the reciprocating mechanism 66.

The reciprocating mechanism 66 includes a pair of supports 75 and 76 that are spaced from one another and through which a shaft 78 is rotatably mounted. Mounted on one end of the shaft 78 is the pulley 79 which is driven by the belt 72. Extending substantially along the shaft 78 are a series of crisscross tracks 81. A carriage 82 which includes a circular sleeve 83 rides along the tracks 81 in a reciprocating manner. That is, the carriage 82 follows the tracks 81 from one end to the opposite end thereof and then returns back to the starting point in a reciprocating motion. Mounted on the carriage 82 is a connector element 85 which joins to the three elongate slides 55 which are respectively mounted in the support table tracks 56. Each slide 55 includes a pair of lower laterally extending ears 87 that help maintain the slides 55 in position relative to the respective tracks 56 thereof. Each of the pusher elements 53 is rotatably mounted on a respective slide 55. In this manner each of the pusher elements 53 travels in a reciprocating fashion approximately the width of each of the stations 32 to 35 so as to convey pads 5 forward one station on the plate 50 and then each of the pusher elements 53 returns to its original position to restart with the exception of the last set of pusher elements 53 which push each pad 5 onto the discharge surface 51.

The pulley 70 is connected to a rotating wheel 89 associated with the third glue application station 34 by a belt 90 that also passes over a take up roller 91.

With respect to the loading station 32, a rail 93 is located on the support table 47 on the one side of the plate 50. The pad 5 is initially located on the plate 50 in the region of the first loading station 32 in such a manner that the rear of the pad 5 abuts against the rail 93 and the wraparound cover 4 covers and is coextensive with the pad 5 except that the cover overlap portion 16 extends over and beyond the rail 93. In the embodiment illustrated, the pad 5 and cover 4 are positioned on the plate 50 manually, however, it is foreseen that the apparatus 1 could be positioned so as to receive manufactured pads from another piece of machinery automatically rather than by manual labor. A control panel 94 for operator control of the apparatus 1 is also positioned in the region of the loading station 32.

The creasing station 33 is best illustrated in FIG. 2. The purpose of the creasing station 33 is to place the creases 18 and 19 in the cover 4. In accordance with the present invention, the term crease means any type of treatment or modification of the cover 4 so as to form elongate regions where the cover is weakened, grooved or the like to facilitate and encourage bending of the wraparound cover 4 at those locations.

As each pad 5 and cover 4 move into the creasing station 33, the overlap portion 16 of the cover 4 is positioned above an anvil 97 having an upper serrated surface 98 longitudinally extending thereacross. A grooving tool 101 is mounted on the apparatus frame 40 by pivot 102. The tool 101 includes a pair of elongate arms 104 which are intermedially connected to the pivot 102 so as to extend outwardly on both sides thereof. A first end 105 of each arm 104 is connected to a drive cylinder 106 which is mounted at an opposite end thereof to the frame 40.

In the present apparatus 1 the drive cylinder 106 is automatically controlled by the control panel 94 to reciprocate each time the pusher elements 53 reach their furthermost extension. In this manner the arms 104 are rotated about the pivot 102. Located on a second end 107 of each arm 104 is a head 110. The head 110 includes a pair of elongate knives 112 and 113. The knife 113 is fixed in position relative to the head 110. The head 110 also includes a slide plate 115 upon which the knife 112 is mounted. A release 116 allows an operator to loosen the slide plate 115 and choose the spacing of the knife 112 relative to the knife 113. Each of the knives 112 and 113 have a lower edge 118 and 119 respectively designed to crease or groove the cover 4 when lowered against the cover 4 as the latter is supported by the anvil 97. The knife edges 118 and 119 are preferably approximately the same length as the width of the cover 4 and continuous, although for certain application various lengths may be used. When the drive cylinder 106 is operated so as to urge the head 110 downwardly, the edges 118 and 119 engage the wraparound cover overlap portion 16 so as to pinch the cover 4 against the anvil 97 and so as to produce the creases 18 and 19.

The glue application station 34 is perhaps best seen in FIG. 3. A glue pot 122 is mounted on and supported by the frame 40. Received in the glue pot 122 is a wheel 123 which is pivotally mounted on the frame 40 so as to be rotatable as a pad 5 passes thereover. The wheel 123 is also fixedly connected to the pulley 89 such that movement of the belt 90 causes rotation of the pulley 89 and subsequent rotation of the wheel 123 through the glue pot 122 with glue therein. In this manner glue is picked up on the outer surface 124 of the wheel 123 and a layer of glue is deposited thereon during each rotation to the pot 122. As the pad 5 passes into and through the glue application station 34 a bead of glue 23 is automatically placed along the entire lower side of the pad 5 near and parallel to the rear thereof.

The folding station 35 is illustrated in various stages of operation in FIGS. 5 through 8. The purpose of operation at the folding station 35 is to fold the wraparound cover overlap portion 16 about the rear of the pad 5 and underneath the pad 5 so as to engage the cover bottom section 22 with the glue bead 23. Located at the folding station 35 is a holddown mechanism 128 and a folding mechanism 129.

The holddown mechanism 128 includes a pair of pivot arms 131 which is pivotally attached to the frame 40 by a pivot pin 132. The pivot arms 131 extend from either side of the pivot pin 132. A first end 134 of each pivot arm 131 is attached to a reciprocating control cylinder 136 that is in turn mounted on the frame 40 by a connector 137.

Each pivot arm 131 has a second end 139 connected to an adjustable foot 140. The foot 140 is positioned relative to the table surface 48 and to a pad 5 so as to have two positions. In the first raised position shown in solid lines in FIG. 5 the foot is raised to allow the pad 5 to be positioned beneath the foot 140. The foot 140 has a second lowered position which is shown in phantom lines in FIG. 5 where the foot 140 comes down upon the cover 4 and pad 5 so as to hold them in place relative to the plate 50 during the folding process described below. Positioning of the foot 140 is controlled by operation of the cylinder 136 which is in turn controlled by the control panel 94. The foot 140 is in the raised position as the pad 5 enters and leaves the folding station 35 and is in a lowered position when folding occurs.

A pair of lever arms 143 are also pivotally connected to the frame 40 by a pivot pin near a first end 145 thereof. Pivotally connected to a second end 146 of each lever arm 143 is a hand 149 by a pivot pin 150. Each lever arm 143 is also connected to a reciprocating cylinder 153 approximately intermediate between the ends 145 and 146. The cylinder 153 is connected at an opposite end thereof to the frame 40 by connector 147 so as to move the lever arm 143 upwardly and downwardly with operation of the cylinder 153 which is controlled by the control panel 94.

Also located in the folding station 35 is a rolling knuckle 157. The knuckle 157 includes an upright support element 158 and a rotatable wheel 159 providing a cam follower surface. The wheel 159 works in cooperation with the hand 149.

The hand 149, as is seen in FIGS. 5 through 8 has an initial engagement outer end 163. The hand 149 also includes a mouth 164 having a cupping shape and having a wrapper engaging surface 166 and a rear surface 167. The mouth 164 further has a lower cam surface 169. The hand 149 rotates freely upon the pivot pin 150 so as to swing downwardly due to gravity when free. A stop 171 on the lever arm 143 prevents the hand 149 from swinging past the position shown in FIG. 5 relative to the lever arms 143.

In sequence, as the lever arms 143 rotate downwardly under control of the cylinder 153, the hand 149 also moves downwardly from the position shown in FIG. 5. The leading edge on the outer end 163 engages the cover overlap portion 16, as is shown in FIG. 6, and bends the overlap portion 16 about the crease 18. As the hand 149 continues downwardly, the wheel 159 cam follower surface engages and rolls along the cam surface 169, as is shown in FIG. 7. The wheel 159 supports the distal end of the hand 149 as it rolls along the cam surface 169 and causes the hand 149 to rotate about the pivot pin 150 and move forwardly. This also causes the wrapper engaging surface 166 to become more horizontal and to push the cover overlap portion 16 forward towards the pad 5.

Figure 8:
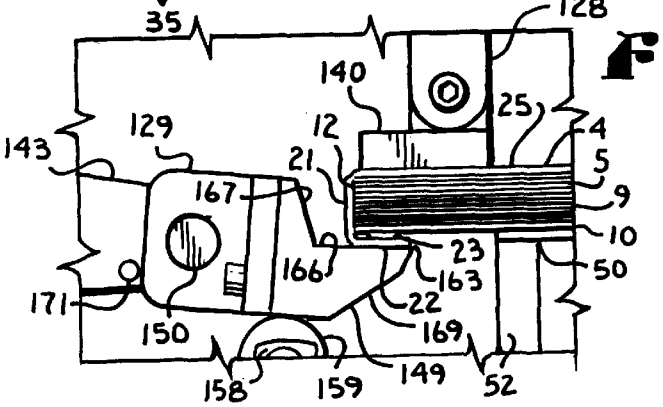
FIG. 8 is an enlarged and fragmentary cross sectional view of the apparatus similar to FIG. 5, with the hand folding the end of the cover onto a glue strip on the bottom of the pad and completing the joining of the wraparound cover to the pad.

Eventually the hand 149 comes to the position shown in FIG. 8 wherein the wrapper engaging surface 166 is relatively horizontal and biases the cover bottom section 22 upwardly into the glue bead 23. In this position the cover rear section 21 is also pushed and positioned against the rear of the pad 5. This position is held by the hand 149 until the cover bottom section 22 firmly adheres to the glue 23 after which the process associated with the hand 149 is reversed. Sufficient pressure is applied to preferably force the glue 23 into the fibers of both the cover 4 and the backer sheet 10. During reversal, the hand 149 again rolls on the wheel 159 along the cam surface 169 and begins to rise as the lever arm 143 raises. The hand 149, due to gravity, rotates about the pin 150 until it engages a stop 171 and is then raised to the position seen in FIG. 5. The folding mechanism 129 is then ready to repeat the process with a new pad 5. The foot 140 is then raised. While the foot is lowered, the foot 140 prevents the pad 5 and cover 4 from moving relative to one another or from moving relative to the plate 50.

As is noted above, the pusher elements 53 push the pads 5 to each of the sequential operational stations 33, 34 and 35 after the pads have been placed on the loading station 32. Each pad 5 is allowed to stay at the respective station until such time as the operation required at that station is complete. After the final folding step at the folding station 35, the pad 5 is discharged by the pusher elements 53 onto the discharge table 51. In this manner the application of the cover 4 to the pad 5 is completed.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for applying a wrap around cover to a pad wherein the cover has a top section, a rear section and a bottom section after application and wherein the cover before application is generally planar; said apparatus comprising:

a) a support frame having a table with an upper surface adapted to receive said pad and cover prior to application;

b) a folding mechanism automatically adapted to fold an outwardly extending portion of said cover from a planar configuration thereof about and under the pad;

c) said folding mechanism including:

d) a lever arm pivotally mounted on said frame;

e) a hand pivotally mounted on said lever arm and positioned to be adapted to engage the outwardly extending portion of said cover as said hand lowers; said hand having a tip for initially urging the outwardly extending portion of the cover downwardly and then including a cupping surface for folding the bottom section under a pad to which a cover is being applied; and f) a reciprocation mechanism operably swinging said lever arm and said hand from a raised position to a lowered position.

2. The apparatus according to claim 1 wherein:

a) said hand includes a cam surface; and including b) a rolling cam follower mounted on said frame and operably engaging said hand cam surface as said hand moves to the lowered position thereof so as to pivot said hand cupping surface into position adapted to mate the cover bottom section with an undersurface of a pad.

3. The apparatus according to claim 1 including a hold-down mechanism having:

a) a pivot arm pivotally connected to said frame;

b) a reciprocating device for moving said pivot arm; and c) a foot located near a distal end of said pivot arm and positioned so as to be adapted to engage and hold a pad and a cover in place relative to each other on said table as said folding mechanism folds the cover about the pad.

4. The application according to claim 1 wherein:

a) said folding mechanism is located at a folding station; and including:

b) a loading station adapted to initially and sequentially receive a plurality of pads on said table surface; and d) a conveyor mechanism adapted to sequentially convey pads from said loading station to said folding station.

5. The apparatus according to claim 4 wherein said conveyor mechanism includes:

a) a plurality of pusher elements each pivotally mounted on a slide and having a raised position to be engageable with a pad and a lowered position so as to be beneath a pad; and b) a reciprocating mechanism to move said pusher elements along said frame so as to be operably move a pad between said stations.

6. The apparatus according to claim 4 including:

a) a gluing station having a glue wheel positioned and aligned to place a bead of glue on an underside of a pad passing through said gluing station.

7. The apparatus according to claim 4 including:

a) a creasing station having a creasing mechanism;

b) said creasing mechanism including a head pivotally connected to said frame and having a raised position and a lowered position; said head including a creasing tool to form at least one crease in a cover at the location where the cover wraps about a pad so as to facilitate bending of the cover at the location of the crease.

8. The apparatus according to claim 7 wherein:

a) said creasing mechanism includes a pair of spaced and elongate knife edges that are, positioned so as to form two creases in a cover whereat the cover bends in wrapping about the rear of a pad.

9. The apparatus according to claim 8 wherein:

a) said knife edges are selectively adjustable in spacing relative to one another.

10. The apparatus according to claim 8 wherein:

a) said creasing mechanism includes an anvil having a serrated surface and positioned so as to be directly beneath and in close proximity to said knife edges when in the lowered position thereof so as to be adapted to crease a cover therebetween.

11. An apparatus for folding and securing a wrap around cover to a pad; said apparatus comprising:

a) a loading station adapted to sequentially receive individual pads with a cover blank positioned over each pad;

b) a creasing station including a creasing mechanism adapted to crease the cover blank to facilitate folding of the cover about the pad;

c) a gluing station having a glue applicator for applying a bead of glue to an underside of each pad;

d) a folding station including a holddown mechanism for holding the cover in position relative to the pad and a folding mechanism having a moving hand that is adapted to engage and fold a portion of the cover over the back and a part of the underside of the pad so as to engage the glue bead; and e) a conveyor mechanism for stepwise moving each pad through each of said stations in sequential order.

12. A method of folding a wraparound cover about a pad comprising the steps of:

a) providing the following apparatus:

i. a loading station adapted to sequentially receive individual pads with a cover blank positioned over each pad;

ii. a creasing station including a creasing mechanism adapted to crease the cover blank to facilitate folding of the cover about the pad;

iii. a gluing station having a glue applicator for applying a bead of glue to an underside of each pad;

iv. a folding station including a holddown mechanism for holding the cover in position relative to the pad and a folding mechanism having a moving hand that is adapted to engage and fold a portion of the cover over the back and a part of the underside of the pad so as to engage the glue bead; and v. a conveyor mechanism for stepwise moving each pad through each of said stations in sequential order; and b) sequentially stepping a pad and cover through each of said stations utilizing said conveyor mechanism.

13. An apparatus for folding and securing a wraparound cover to a pad; said apparatus comprising:

a) a frame having an upper surface adapted to receive the pad;

b) a loading station wherein a pad is initially receivable on said surface and the cover, as a blank and with an overlap portion extending outward from the pad, is placed over the pad;

c) a creasing station including a creasing mechanism; the creasing mechanism having a first arm that is pivotally attached to the frame and includes a first reciprocating mechanism for moving an operating end of the arm between raised and lowered positions; said arm operating end including a pair of spaced knife edges; said creasing mechanism further including a lower anvil; said knife edges and said anvil capturing the cover overlap portion therebetween when in the lowered position thereof so as to crease the cover with the edges at two spaced locations;

d) a gluing station having a glue pot, a glue wheel, and a wheel rotating mechanism operably rotating said wheel; said glue wheel rotating through said glue pot so as to receive glue on an outer surface thereof and being aligned to apply a bead of glue to an undersurface of the pad as the pad is located in said gluing station;

e) a folding station having a holddown mechanism and a folding mechanism; said holddown mechanism including a foot pivotally connected to said frame and a second reciprocating mechanism for moving said foot between a raised and a lowered position thereof; said foot engaging the cover during folding to prevent movement of a top of the cover relative to the pad; said folding mechanism including a lever arm pivotally connected to said frame, a third reciprocating mechanism for moving said lever arm between a raised and a lowered position thereof, a hand and a cam follower; said hand being pivotally connected to said lever arm near a distal end thereof and including a cover engaging surface and a cam surface; said cam surface engaging said cam follower as said hand lowers so as to urge the cover overlap portion to wrap about pad and secure to the bead of glue; and e) a conveyor mechanism to sequentially step the pad through each of said stations.

* * * * *